US005320055A

United States Patent [19]

Goldbach

[11] Patent Number: 5,320,055

[45] **Date of Patent: * Jun. 14, 1994**

[54] DOUBLE-LAYERED VESSEL WALL CONSTRUCTION WITH LONGITUDINALLY STAGGERED CELL-TO-CELL ACCESS OPENINGS THROUGH WALL LAYER-CONNECTING PLATES

[75] Inventor: Robert D. Goldbach, Millford, Pa.

[73] Assignees: Metro Machine Corp., Norfolk, Va.; Marinex International, Inc., Hoboken, N.J.

[ * ] Notice: The portion of the term of this patent subsequent to Feb. 11, 2009 has been disclaimed.

[21] Appl. No.: 953,141

[22] Filed: Sep. 29, 1992

[51] Int. Cl.[5] ..... B63B 3/20

[52] U.S. Cl. ..... 114/65 R; 114/74 R

[58] Field of Search ..... 114/65 R, 65 A, 72, 114/73, 74 R, 74 A, 77 R, 78

[56] References Cited

U.S. PATENT DOCUMENTS

| | | | |
|---|---|---|---|
| 855,154 | 5/1907 | Babcock | 114/65 R |
| 3,064,612 | 11/1962 | Gardner et al. | 114/74 A |
| 3,623,626 | 11/1971 | Bridges | 114/74 A |
| 4,660,491 | 4/1987 | Murata et al. | 114/65 R |
| 5,085,161 | 2/1992 | Cuneo et al. | 114/65 R |
| 5,086,723 | 2/1992 | Goldbach et al. | 114/78 |
| 5,090,351 | 1/1992 | Goldbach et al. | 114/64 R |

*Primary Examiner*—David M. Mitchell
*Assistant Examiner*—Stephen P. Avila
*Attorney, Agent, or Firm*—Cushman, Darby & Cushman

[57] ABSTRACT

In a double-layered vessel wall construction, which has two transversally spaced longitudinal wall layers, and wall layer-connecting plates, each of which has one longitudinal edge weldingly joined in a plate edge-to-plate edge joint in one of the longitudinal wall layers, and an opposite longitudinal edge weldingly joined in a plate edge-to-plate edge joint in the other of the longitudinal wall layers, so as to divide space enclosed by the wall construction into a plurality of cells that are typically closed at opposite ends by transverse bulkheads, cell-to-cell access openings are longitudinally staggered and located near cell ends. Accordingly, forced air ventilation can sweep through virtually all of the space enclosed within the wall construction, and a worker who falls while climbing from one cell to another via an access hole can fall no further than the vertical extent of the two cells which are interconnected by that access opening.

18 Claims, 3 Drawing Sheets

DOUBLE-LAYERED VESSEL WALL CONSTRUCTION WITH LONGITUDINALLY STAGGERED CELL-TO-CELL ACCESS OPENINGS THROUGH WALL LAYER-CONNECTING PLATES

BACKGROUND OF THE INVENTION

The following U.S. patents:

| Patentee | U.S. Pat. No. | Issue Date |
|---|---|---|
| Cuneo et al. | 5,085,161 | February 4, 1992 |
| Goldbach et al. | 5,086,723 | February 11, 1992 |
| Goldbach et al. | 5,090,351 | February 25, 1992 |
| Goldbach et al. | 5,269,246 | December 14, 1993 |

disclose modular, double-walled vessel hull constructions in which one or more longitudinal walls of at least a portion of the vessel hull is fabricated of two transversally spaced longitudinal extending wall layers each made of plates weldingly joined at edges, and a series of wall layer-connecting plates, each of which has one longitudinal edge weldingly joined in a respective plate joint in one of those longitudinal wall layers, and an opposite longitudinal edge weldingly joined in the transversally corresponding plate joint in the other of those longitudinal wall layers.

A typical use of the vessel wall construction is for fabrication of modules for longitudinal midbodies of vessels for transporting flowable cargo stored in tanks each of which is defined at least in part by a layer of at least one such double walls. Some of the double walls may have a layer which forms an external boundary of the vessel, i.e., it forms part of a bottom wall or side wall of a hull. In such instances, one of the wall layers forms part of an outer hull, and the other forms part of an inner hull. In other instances, a double wall may provide a longitudinal bulkhead internally of a vessel hull, e.g., extending vertically between a bottom wall and a deck so as to divide the internal space enclosed by the hull, into a greater number of mutually isolated cargo tanks, arranged on transversally opposite sides of the longitudinal bulkhead.

Typically, in such vessel longitudinal midbody constructions, each module is a longitudinal segment of the whole, each is fabricated so as to have, not only a hull portion (including a deck portion) and possibly one or more longitudinal bulkheads, but also a transverse bulkhead, preferably provided at one end of the respective module. The modules are serially welded together end-to-end to provide a vessel longitudinal midbody. A vessel bow member is welded to one end of the longitudinal midbody, and a vessel stern member is welded to the opposite end of the longitudinal midbody, in order to constitute a complete vessel. The longitudinal bulkheads (if provided) and transverse bulkheads internally divide the space enclosed by the vessel hull into a plurality of cargo tanks. Other equipment normally provided on the particular type of vessel can be installed, as will be appreciated by those skilled in the art.

In each double wall of the vessel hull, and longitudinal bulkhead(s) (if provided), the wall layer-interconnecting plates which join the two wall layers at the plate-to-plate edge joints divide the space within each such double wall into a plurality of compartments or cells each delimited by two wall layers, two wall layer-interconnecting plates, and two transverse bulkheads.

Some of these cells can be intended to remain empty in use, or to act as pipe chaces, keel ducts, ventilation ducts or have other uses than carrying cargo. Not unusually, some can be intended for carrying (typically) sea water or river or lake water as ballast, for helping maintain a sufficiently low center of gravity and high density as to permit safe vessel operation when the cargo tanks are partly or completely empty.

In conventional double-hulled vessels, the plates which interconnect the inner and outer hulls are often provided with openings. These permit the vessel operations to fill and empty the compartments with ballast without providing piping to each compartment. They also permit the vessel operators to inspect the compartments (when the compartments are emptied of ballast), e.g., looking for corrosion damage and leaks from or to the compartments, indicating a need for repairs and maintenance. In such conventional double-hulled vessels, the openings from one compartment to the next are all aligned from plate to plate, girthwise.

This conventional layout can be the source of several problems which have safety implications.

If all the openings are provided near one end of each module, ventilation efforts will tend to be more effective at the module end that is near the openings; fumes due to leaks from the cargo tanks into the cells will tend to build towards unsafe levels at cell ends furthest from the openings while ventilation is being conducted.

Inspectors and repairers, who are climbing through the cell array, from cell to cell on ladders conventionally provided, should they slip, could fall, drop through an opening, continue to fall through the next compartment and next opening, and so on, striking ladder rings and the edges of openings, and thereby becoming seriously injured. If the ventilator or respirator that the worker is wearing is not operating properly, or has been removed by the worker, fumes that have built up at a poorly ventilated far end of a compartment could cause the worker to become dizzy, disoriented or subject to blacking out while, after walking the length of the compartment to its ventilated end, they had stepped onto the ladder to climb up or down to a neighboring compartment.

The wall layer-connecting plates in a conventional double-hulled tanker may be simple flat plates having such access openings, or they may be stiffened by stiffening ribs or plates welded or otherwise secured thereto (typically to one face, and running crosswise of the plate). A typical wall layer-connecting plate is about seven feet wide, fifty feet long, spaced about eight feet from its closest neighbors, and its access openings are two feet in diameter. The access openings may be provided with sealable hatches for selectively closing them, or they may be simple openings that are intended to remain always open. Such access openings can also be called manholes.

SUMMARY OF THE INVENTION

In a double-layered vessel wall construction, which has two transversally spaced longitudinal wall layers, and wall layer-connecting plates, each of which has one longitudinal edge weldingly joined in a plate edge-to-plate edge joint in one of the longitudinal wall layers, and an opposite longitudinal edge weldingly joined in a plate edge-to-plate edge joint in the other of the longitudinal wall layers, so as to divide space enclosed by the wall construction into a plurality of cells that are typically closed at opposite ends by transverse bulkheads, cell-to-cell access openings are longitudinally staggered and located near cell ends. Accordingly, forced air ventilation can sweep through virtually all of the space enclosed within the wall construction, and a worker who falls while climbing from one cell to another via an access hole can fall no further than the vertical extent of the two cells which are interconnected by that access opening.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
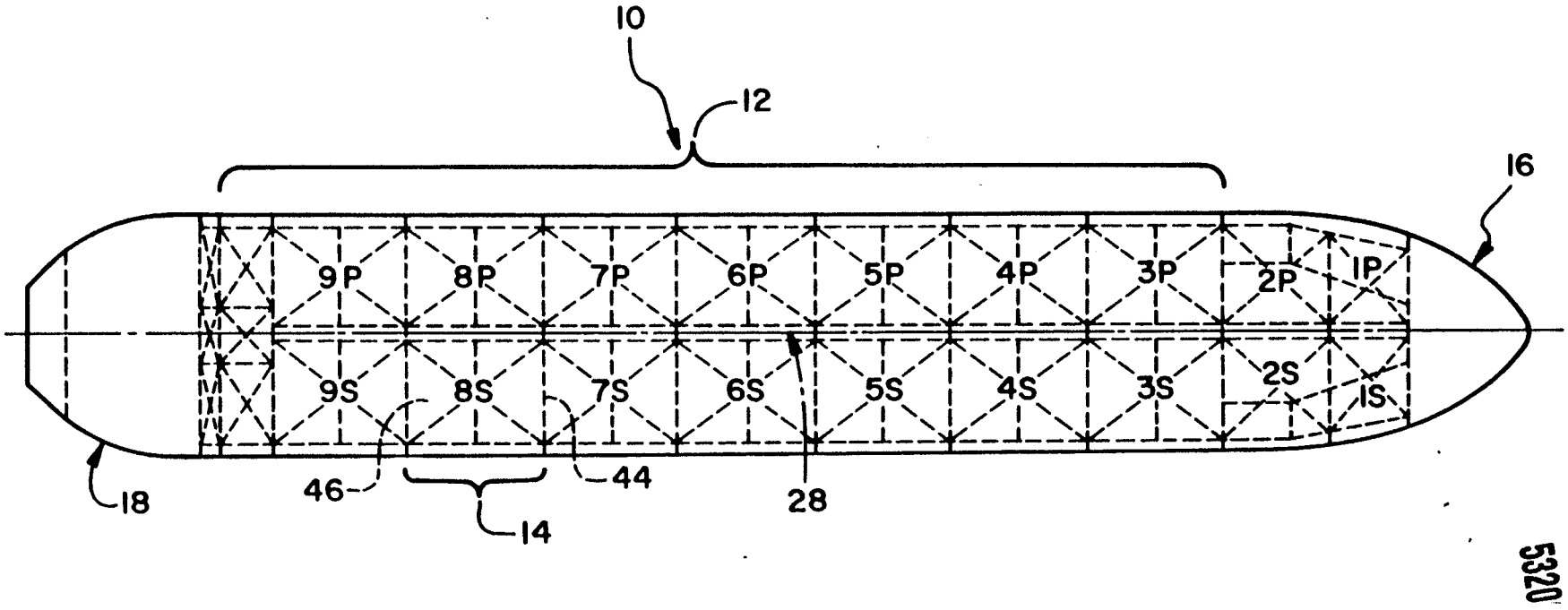
FIG. 1 is a small scale schematic view of a double-hulled vessel having a longitudinal midbody made of a series of modules serially connected end to end.

Referring first to FIG. 1, a double-hulled vessel 10 is shown, e.g., one which has been fabricated in accordance with the teachings of the prior U.S. patents, which are enumerated above in the Background section, but for the differences which are described below with reference to FIG. 3.

The vessel 10 thus includes a longitudinal midbody 12 which is fabricated from a series of modules 14, which are welded together end to end, a bow section 16 and a stern section 18.

Figure 2:
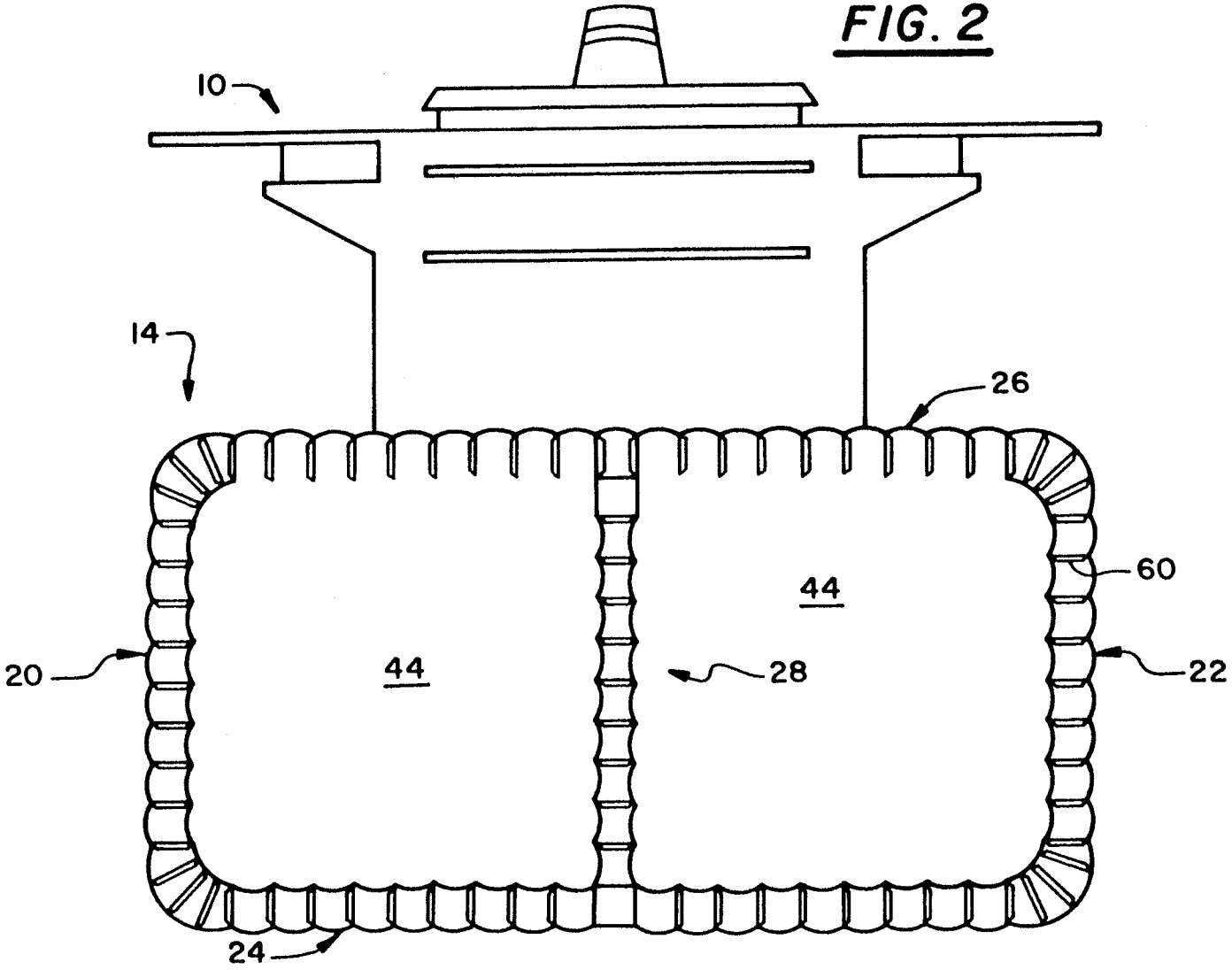
FIG. 2 is an end view of one of these modules, the end facing the viewer being open, and the far end being closed by a transverse bulkhead.

Referring to FIG. 2, each module 14 includes two opposite side wall constructions 20, 22, a bottom wall construction 24, a deck construction 26, and (in this instance, but optionally) at least one longitudinal bulkhead wall construction 28, which joins the deck and bottom at a transversally intermediate location. The several wall constructions merge into one another and join at corners or edges typically as shown.

Any or all of the wall constructions 20, 22, 24, 26 and 28, or portions thereof, can be provided with a longitudinally staggered arrangement of access openings (30, described below in relation to FIG. 3) in accordance with principles of the present invention.

In each wall construction 20–28, there are provided two opposite wall layers 32, 34. Each of these is made of steel plates, which are preferably curved, as shown, and serially joined together in longitudinal welded joints 36 between respective longitudinal edges of the plates.

In each wall construction 20–28, there is further provided a series of wall interconnecting plates 38, each of which has one longitudinal edge welded (as part of a respective T-joint) into a respective welded joint 36 with two edges of respective plates in the one wall layer 32 and an opposite longitudinal edge welded (as part of a respective T-joint) into a respective welded joint 36 with two edges of respective plates in the other wall layer 34.

One end of the module 14 is closed by a transverse bulkhead 44, which is welded in place so that it forms an end wall not only in the enclosed space(s) 46 which, in use, will provide cargo tanks, but also the enclosed spaces 48 which provide the compartments or cells within each wall construction 20–28. (In use, the opposite end of each module is closed by the transverse bulkhead 44 of the next module in the series (FIG. 1).)

While it is preferred that the access opening arrangement of the invention be provided in a double-hulled vessel that has been constructed in accordance with the teachings of one or more of the U.S. patents which are enumerated above in the Background section, it could be provided in double-walled vessels which differ in some constructional principles from those which are disclosed in those patents.

Figure 3:
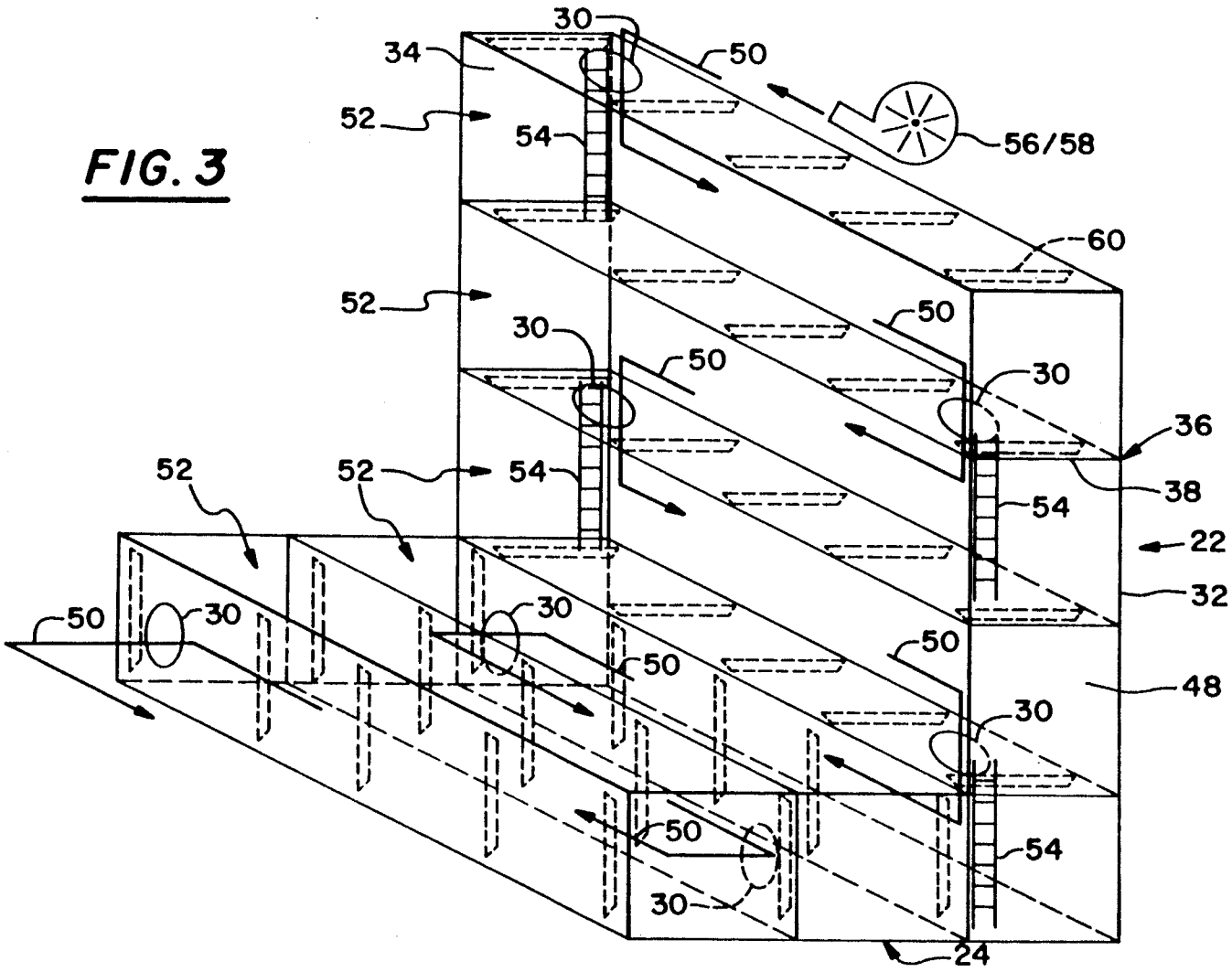
FIG. 3 is a schematic fragmentary perspective view of the module of FIG. 2 showing cell-to-cell access openings provided according to a longitudinally staggering pattern in accordance with principles of the present invention.

In FIG. 3, a portion of a module 14 is shown (in rudimentary, schematic form). Although only one vertical wall construction and one horizontal wall construction have been depicted, the vertical wall construction could represent any of the wall constructions 20, 22 and 28, and the horizontal wall construction could represent any of the wall constructions 24 and 26.

For convenience in description, the term "length" will be used to denote the dimension which, in use, extends longitudinally of the vessel, the term "width" will be used to denote the dimension which extends between the two layers of a wall construction (regardless of whether the wall construction is vertically or horizontally oriented), and the term "depth" will be used to denote the dimension which is perpendicular to both length and width (regardless of whether that dimension extends vertically, as it does in the walls 20, 22 and 28, or transversally horizontally as it does in the walls 24 and 26). The "ends" of a compartment are provided at the respective transverse bulkheads 44.

As indicated in FIG. 3, a special case exists at a corner, where a wall construction merges into another so that one cell may have two neighboring sides provided with access openings 30 in a series which continues from one wall construction into the laterally adjoining wall construction.

In accordance with principles of the present invention, cell-to-cell access to the enclosed space within one or more wall constructions of each of one or more modules 14 of a vessel 10 are provided solely by longitudinally staggered access openings 30.

The staggering pattern is such that, for instance, in the top cell of the vertical wall shown in FIG. 3, the upper access opening 30 is located adjacent the far end of the cell, the lower access opening from that cell to the next lower one in the same wall is located adjacent the near ends of those two cells. Similarly, the ensuing access openings in the series are alternately adjacent the far and near ends of the respective cells. Thus, in no instance are three cells laterally interconnected by access openings which are disposed in axial registry. Therefore, a person cannot fall further from one cell to the next one, and forced air ventilation will sweep in a zig-zag path 50 that traverses all or virtually all of the transverse cross-section of all of the space enclosed within each cell 52.

For completeness, certain features that will be adequately understood by even barest suggestion are rudimentarily shown in FIG. 3 as follows: ladders 54 for climbing up and down from cell to cell through access openings between vertically adjoining cells; blowers 56 for circulating air along the zig-zag path 50; pumps 58 (and associated piping) for filling the cells with liquid ballast or the like (and for emptying them out); and widthwise stiffening bars or plates 60 (which are welded in place).

Each individual access opening 30 may be of conventional construction and size and is typically located within five percent of the length of the respective cell from the closest end of that cell.

The materials of which the wall constructions, modules, longitudinal midbody and vessel are made, and the methods used for fabricating of these structures, can be as disclosed in any of the U.S. patents which are enumerated above in the Background section, modified only as has been described above with reference to FIG. 3.

It should now be apparent that the double-layered vessel wall construction with longitudinally staggered cell-to-cell access openings through wall layer-connecting plates as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A vessel wall construction, comprising:

a first series of longitudinally elongated plates serially welded together along adjoining longitudinal edges to provide a first wall layer having first joints and two longitudinally opposite ends;

a second series of longitudinally elongated plates serially welded together along adjoining longitudinal edges to provide a second wall layer having second joints and two longitudinally opposite ends;

a series of longitudinally elongated wall layer-interconnecting plates each having one longitudinal edge welded into one of said first joints and an opposite longitudinal edge welded into a corresponding one of said second joints, said wall layer-interconnecting plates each extending from end to end of respective of said plates of said first and second series; said wall layer-interconnecting plates dividing space enclosed between said first and second wall layers into a plurality of cells;

means defining a series of access openings through said wall layer-interconnecting plates, in which there is but one access opening between each two laterally adjoining ones of said cells and immediately succeeding ones of said access openings in said series are longitudinally staggered so as to adjoin longitudinally opposite ends of vessel wall construction.

2. The vessel wall construction of claim 1, in which:

said first wall layer forms at least part of an outer hull of a double-hulled vessel and said second wall layer forms at least part of an inner hull of a double-hulled vessel.

3. The vessel wall construction of claim 2, in which:

transverse bulkheads form opposite end walls of each said cell.

4. The vessel wall construction of claim 1, in which:

said first wall layer and said second wall layer form opposite sides of at least part of a longitudinal bulkhead of a double-hulled vessel for separating cargo tanks of said vessel from one another.

5. The vessel wall construction of claim 4, in which:

transverse bulkheads form opposite end walls of each said cell.

6. The vessel wall construction of claim 1, further including:

blower means circulating air along a zig-zag path serially through said cells via said access openings.

7. The vessel wall construction of claim 1, further including:

pump and associated piping means for filling said cells with liquid ballast and for emptying said cells of such ballast.

8. The vessel wall construction of claim 1, wherein:

at least some of said cells are disposed serially vertically adjacent to one another; and further including ladder means disposed within vertically adjoining ones of said cells at respective ones of said access openings for permitting a worker to climb from one such cell to a respective vertically adjoining said cell through a respective said access opening.

9. The vessel wall construction of claim 1, further including:

a plurality of longitudinally spaced transversally extending stiffeners welded to each said wall layer-interconnecting plate.

10. A vessel wall construction, comprising:

a first longitudinally extending wall layer having two longitudinally opposite ends;

a second longitudinally extending wall layer having two longitudinally opposite ends;

a series of longitudinally elongated wall layer-interconnecting plates joined at transversally opposite longitudinal edges thereof, at corresponding locations, to first and second wall layers along joints which extend from end to end of said first and second wall layers; said wall layer-interconnecting plates dividing space enclosed between said first and second wall layers into a plurality of cells;

means defining a series of access openings through said wall layer-interconnecting plates, in which there is but one access opening between each two laterally adjoining ones of said cells and immediately succeeding ones of said access openings in said series are longitudinally staggered so as to adjoin longitudinally opposite ends of vessel wall construction.

11. The vessel wall construction of claim 10, in which:

said first wall layer forms at least part of an outer hull of a double-hulled vessel and said second wall layer forms at least part of an inner hull of a double-hulled vessel.

12. The vessel wall construction of claim 11, in which:

transverse bulkheads form opposite end walls of each said cell.

13. The vessel wall construction of claim 10, in which:

said first wall layer and said second wall layer form opposite sides of at least part of a longitudinal bulkhead of a double-hulled vessel for separating cargo tanks of said vessel from one another.

14. The vessel wall construction of claim 13, in which:

transverse bulkheads form opposite end walls of each said cell.

15. The vessel wall construction of claim 10, further including:

blower means circulating air along a zig-zag path serially through said cells via said access openings.

16. The vessel wall construction of claim 10, further including:

pump and associated piping means for filling said cells with liquid ballast and for emptying said cells of such ballast.

17. The vessel wall construction of claim 10, wherein:

at least some of said cells are disposed serially vertically adjacent to one another; and further including ladder means disposed within vertically adjoining ones of said cells at respective ones of said access openings for permitting a worker to climb from one such cell to a respective vertically adjoining said cell through a respective said access opening.

18. The vessel wall construction of claim 10, further including:

a plurality of longitudinally spaced transversally extending stiffeners welded to each said wall layer-interconnecting plate.

* * * * *